US005354214A

United States Patent [19]

Aso et al.

[11] Patent Number: 5,354,214

[45] Date of Patent: Oct. 11, 1994

[54] PRINTED CIRCUIT BOARD ELECTRICAL CONNECTOR WITH MOUNTING LATCH CLIP

[75] Inventors: Akira Aso; Russell J. Leonard, both of Naperville, Ill.; George M. Simmel, Kawasaki, Japan

[73] Assignee: Molex Incorporated, Lisle, Ill.

[21] Appl. No.: 97,347

[22] Filed: Jul. 23, 1993

[51] Int. Cl.[5] ..... H01R 9/07

[52] U.S. Cl. ..... 439/492; 439/67

[58] Field of Search ..... 439/492–499, 439/67, 77

[56] References Cited

U.S. PATENT DOCUMENTS

| | | | |
|---|---|---|---|
| 4,235,500 | 11/1980 | Belopavlovich et al. | 439/495 |
| 4,640,562 | 2/1987 | Shoemaker | 439/495 |
| 4,695,108 | 9/1987 | Ichitsubo | 439/495 |
| 4,734,053 | 3/1988 | Imai | 439/495 |
| 4,778,403 | 10/1988 | Ikesugi et al. | 439/329 |
| 4,900,268 | 2/1990 | Kunishi | 439/493 |
| 5,094,624 | 3/1992 | Bakke et al. | 439/326 |
| 5,173,058 | 12/1992 | Broeksteeg et al. | 439/267 |
| 5,213,534 | 5/1993 | Gardner et al. | 439/495 |

OTHER PUBLICATIONS

Molex Full Line Catalog, 1989, p. 3G.

*Primary Examiner*—David L. Pirlot

*Attorney, Agent, or Firm*—Charles S. Cohen

[57] ABSTRACT

An electrical connector is disclosed for interconnecting a flat flexible circuit to a printed circuit board. The connector includes a dielectric housing having an elongated mouth for receiving the flat flexible circuit. Terminals are mounted in the housing and are adapted for coupling appropriate conductors of the flat flexible circuit with circuit traces on the printed circuit board. An actuator has an elongated tongue for insertion into the mouth of the housing to maintain the flat flexible circuit in engagement with the terminals. At least one latch/mounting clip is mounted on the housing, and a complementary interengaging latch is provided between a first portion of the clip and the actuator to hold the actuator in its inserted position on the housing. A second portion of the clip is adapted for operative association with the printed circuit board.

19 Claims, 4 Drawing Sheets

PRINTED CIRCUIT BOARD ELECTRICAL CONNECTOR WITH MOUNTING LATCH CLIP

FIELD OF THE INVENTION

This invention generally relates to the art of electrical connectors and, more particularly, to an electrical connector for interconnecting a flat flexible circuit component to a printed circuit board, and including a latch-/mounting clip therefor.

BACKGROUND OF THE INVENTION

Various electrical connectors have been provided to effect zero insertion force on either flat flexible cable or flexible printed circuitry (hereinafter generically referred to as a flat flexible circuit), and interconnecting the flat flexible circuit to a printed circuit board. Connectors of this type typically utilize a dielectric housing, such as of molded plastic material, having terminals mounted therein and a movable actuator insertable into the housing for pressing the flat flexible circuit against the terminals.

Heretofore, the dielectric housing of the connector and the actuator had complementary interengaging latch means for holding the actuator in an inserted position. When the connector is used for interconnecting the flat flexible circuit to a printed circuit board, separate mounting, polarizing or other components often are mounted on the housing. For instance, a separate metal retainer or "fitting nail" is sometimes added to the housing for surface mounting the connector to the circuit board. A fitting nail generally has a flat or planar portion for soldering to a dummy solder pad on the board to secure the connector to the board. Separate mounting pegs also may be added to the housing, as well as separate polarizing posts. One of the problems with all of these separate components is that they add considerably to the cost of the connectors.

The mounting pegs and/or polarizing posts may be formed integral with the housing, similar to the latch means for the actuator. However, such components are extremely small and fragile, especially when molded with high temperature plastics.

This invention is directed to solving these problems by providing an electrical connector of the character described above which includes a unique latch/mounting clip mounted on the housing and which performs a dual function of latching the actuator to the housing as well as providing the flexibility of a mounting and/or polarizing means for securing the housing to the printed circuit board.

SUMMARY OF THE INVENTION

An object therefore of the invention is to , provide an electrical connector for interconnecting a flat flexible circuit to a printed circuit board.

Another object of the invention is to provide a unique latch/mounting clip on the connector housing as described below.

In the exemplary embodiment of the invention, the electrical connector includes a dielectric housing having an elongated mouth for receiving the flat flexible circuit. Terminal means are mounted in the housing and are adapted for coupling appropriate conductors of the flat flexible circuit with circuit traces on the printed circuit board. An actuator has an elongated tongue for insertion into the mouth of the housing for maintaining the flat flexible circuit in engagement with the terminal means. The invention is directed to at least one latch-/mounting clip mounted on the housing, with complementary interengaging latch means between a first portion of the clip and the actuator to hold the actuator in its inserted position on the housing. A second portion of the clip is adapted for operative association with the printed circuit board.

As disclosed herein, at least the first portion of the latch/mounting clip is flexible, and the complementary interengaging latch means thereby provide a snap-latch means for automatically latching the actuator in response to movement of the actuator to its inserted position. Preferably, the latch/mounting clip is fabricated of metal, and the complementary interengaging latch means include a camming latch boss on the actuator and past which the first portion of the clip snaps to give an audible indication of a fully inserted position of the actuator.

A number of embodiments of the invention are disclosed herein for designing the second portion of the latch/mounting clip for operative association with the printed circuit board. The second portion may be generally planar to provide a "fitting nail" for soldering to a mounting pad on the printed circuit board. The fitting nail may be generally perpendicular or generally parallel to the insertion direction of the actuator. A polarizing peg also may be formed out of the generally planar second portion of the latch/mounting clip and adapted for insertion into an appropriate polarizing hole in the printed circuit board. On the other hand, the entire second portion of the latch/mounting clip may form a polarizing peg projecting either generally perpendicular or generally parallel to the insertion direction of the actuator.

Still further, the second portion of the latch/mounting clip may form a boardlock or mounting peg for insertion into an appropriate mounting hole in the printed circuit board. The mounting peg may project from the housing in a direction generally parallel to or in a direction generally at a right-angle to the direction of insertion of the actuator.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
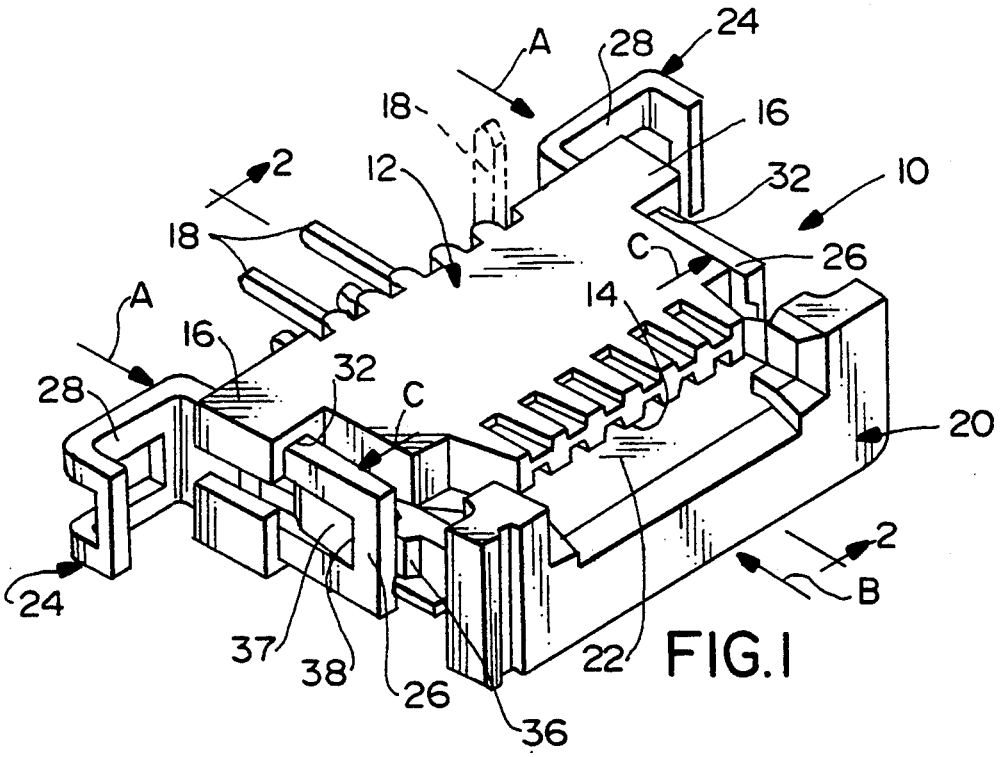
FIG. 1 is a perspective view of an electrical connector embodying the concepts of the invention.

Referring to the drawings in greater detail, and first to FIG. 1, the invention is incorporated in an electrical connector, generally designated 10, for interconnecting a flat flexible circuit to a printed circuit board. The flat flexible circuit and the printed circuit board are not shown in FIG. 1 in order to avoid cluttering the illustration. However, connectors of the type shown in FIG. 1 are well known in the art.

More particularly, connector 10 includes a dielectric housing, generally designated 12, which is unitarily molded of plastic material. The dielectric housing has an elongated mouth 14 into which an end of the flat flexible circuit is inserted. The housing has a pair of ears 16 projecting from opposite sides or ends thereof. The housing mounts a plurality of through-hole terminals 18 (FIG. 2A) which include base 18*a* with a resilient contact arm 18*b* extending therefrom for contacting the flat flexible circuit. A second arm 18*c* extends from base 18*a* in the same direction, generally parallel to and spaced from contact arm 18*b*. Such second arm 18*c* includes a barb 18*d* for securing the terminal 18 within housing 12. In addition, such second arm 18*c* also serves to guide actuator 20 during insertion into the housing 12. Solder tail portions 18*e* extend in a staggered array from base 18*a* in a direction opposite from arms 18*b* and 18*c* for insertion into appropriate holes in the printed circuit board and for soldering to appropriate circuit traces on the board and/or in the holes A surface mount tail portion 18′ is shown in phantom in FIG. 1 to illustrate that the tail portions of the terminals can be configured for surface mounting to circuit traces on the printed circuit board rather than for insertion into holes in the printed circuit board, as is known in the art.

An actuator, generally designated 20, is provided with an elongated tongue 22 for insertion into mouth 14 of housing 12. The tongue of the actuator maintains the flat flexible circuit in engagement with the terminal means within the housing, as is well known in the art.

Figure 2A:
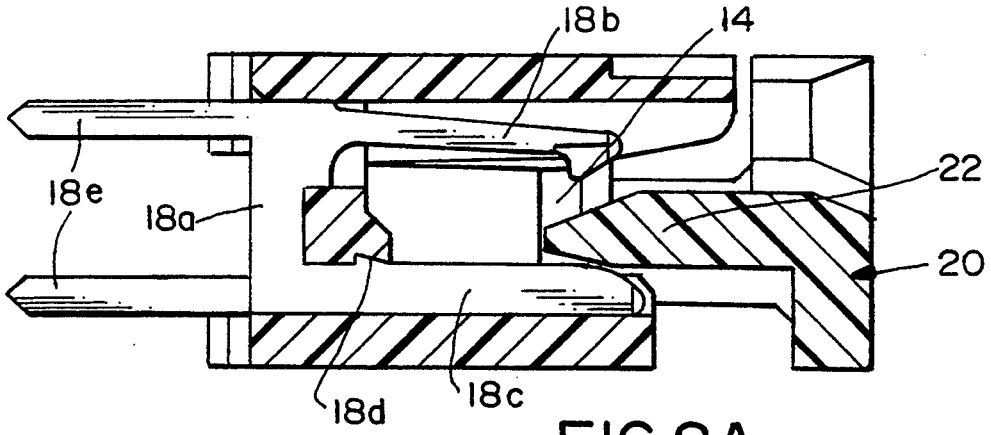
FIG. 2A is a section view taken generally along line 2—2 of FIG. 1.
Figure 2B:
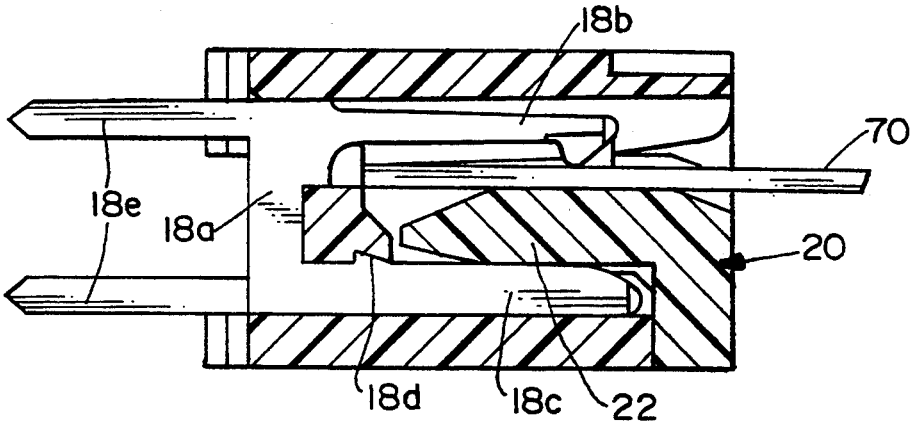
FIG. 2B is a section view similar to that of FIG. 2A but with the flat flexible circuit inserted into the connector and the actuator in its closed position.

FIG. 2A shows a section view of the connector 10 in its "open" position prior to insertion of the flat flexible circuit. FIG. 2B shows the same section but with flat flexible circuit 70 inserted into the mouth 14 of the housing 12 and the actuator 20 in its "closed" or operational position.

The invention contemplates the provision of at least one latch/mounting clip, generally designated 24, mounted on connector housing 12. Two latch/mounting clips 24 are shown at opposite ends of the housing in the preferred embodiment of FIG. 1. Generally, each latch/mounting clip 24 includes complementary interengaging latch means between a first portion 26 of the clip and actuator 20 to hold the actuator in its fully inserted position relative to the housing as shown in FIG. 1. The clip includes a second portion 28 which is adapted for operative association with the printed circuit board.

Figure 3:
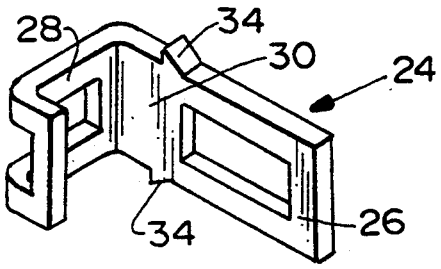
FIG. 3 is a perspective view of one of the latch-/mounting clips of the connector shown in FIG. 1.

More particularly, referring to FIG. 3 in conjunction with FIG. 1, each latch/mounting clip 24 includes a base section 30, with first and second portions 26 and 28, respectively, projecting from opposite ends thereof. The latch/mounting clips are inserted into receptacle means 32 (FIG. 1) in ears 16 of housing 12, in the direction of arrows "A". As seen in FIG. 3, base section 30 has outwardly projecting barbs 34 for skiving into the plastic material of the housing within receptacle means 32 to securely mount the clips in the housing.

Figure 11:
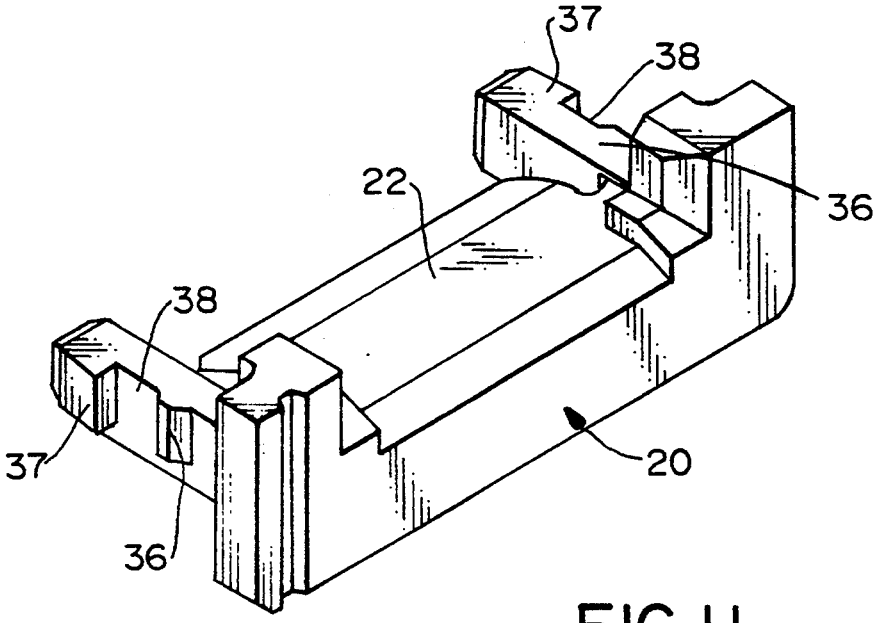
FIG. 11 is a perspective view of the actuator of the electrical connector of the present invention.

As stated above, first portion 26 of each latch/mounting clip 24 includes complementary interengaging latch means between the first portion and actuator 20 to hold the actuator in its fully inserted position relative to the housing. As best seen in FIG. 11, actuator 20 is provided with chamfered, camming latch bosses 36 at opposite ends thereof as well as projections 37 to define cutouts 38 which engage first portions 26 of the clips when the connector is assembled by inserting the actuator into the housing in the direction of arrow "B" (FIG. 1). As the actuator 20 is moved to its closed position, the latch bosses cam first portions 26 of the clips outwardly in the direction of arrows "C" until the actuator is in its fully inserted position, whereupon the first portions will snap back inwardly to latching engagement bosses 36. Preferably, the latch/mounting clips are stamped and formed from sheet metal material, and this snapping action of the first portions of the clips render an audible signal to indicate when the actuator is fully inserted.

As stated above, second portions 28 of latch/mounting clips 24 are adapted for operative association with the printed circuit board. In the form of the latch/mounting clips shown in FIGS. 1 and 3, second portions 28 are generally flat or planar for providing "fitting nails" to secure connector 10 to the printed circuit board. In other words, the planar second portions of the latch/mounting clips are soldered to "dummy" solder pads on the printed circuit board and, thereby, securely mount the connector (particularly the housing and terminal means) to the printed circuit board.

Figure 4:
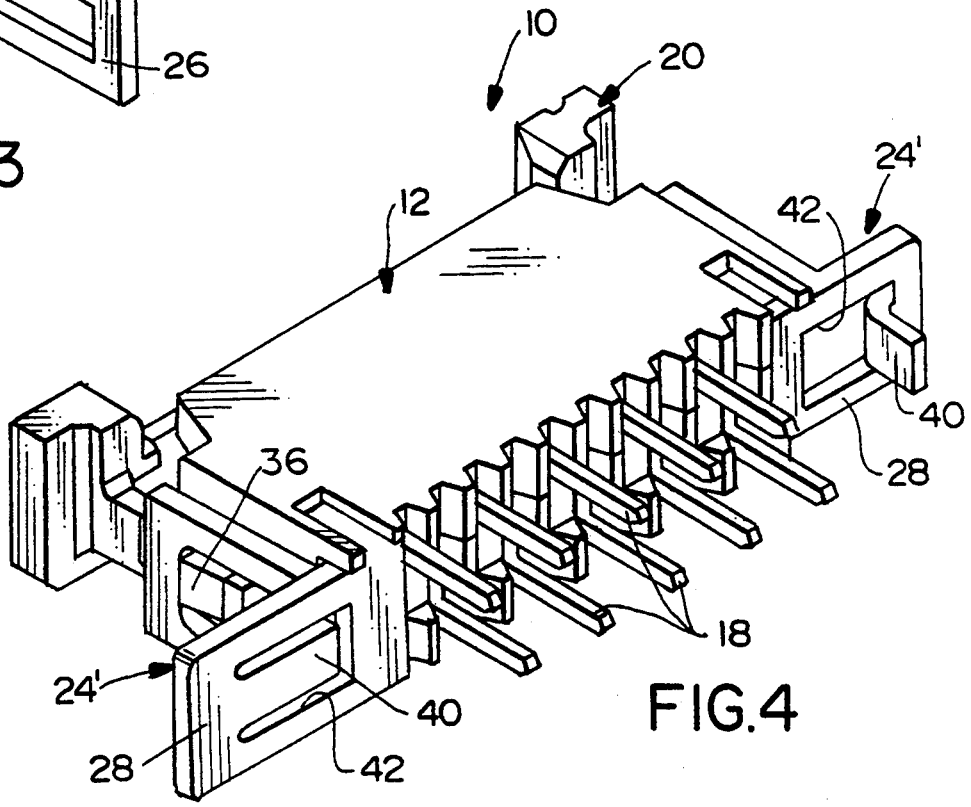
FIG. 4 is a perspective view of an electrical connector embodying an alternate form of latch/mounting clip.

FIG. 4 shows electrical connector 10 with latch/mounting clips 24′ very similar to those described above in relation to FIGS. 1 and 3. Therefore, like reference numbers have been applied to like components in FIG. 4 corresponding to the above detailed description of FIGS. 1 and 3.

Specifically, each latch/mounting clip 24′ in FIG. 4 has an integral cantilevered tongue 40 formed by a U-shaped slot 42 in second portion 28 which provides a "fitting nail" for the connector. These tongues 40 can be used as polarizing pegs for insertion into appropriate polarizing holes in the printed circuit board. For instance, tongue 40 of the right-hand latch/mounting clip 24′ in FIG. 4 is shown bent out of the plane of second portion 28 of the clip. However, tongue 40 of the left-hand clip 24′ is retained as coplanar with second portion 28 of that clip. Therefore, tongue 40 of the right-hand clip can be used as a polarizing post.

Figure 5:
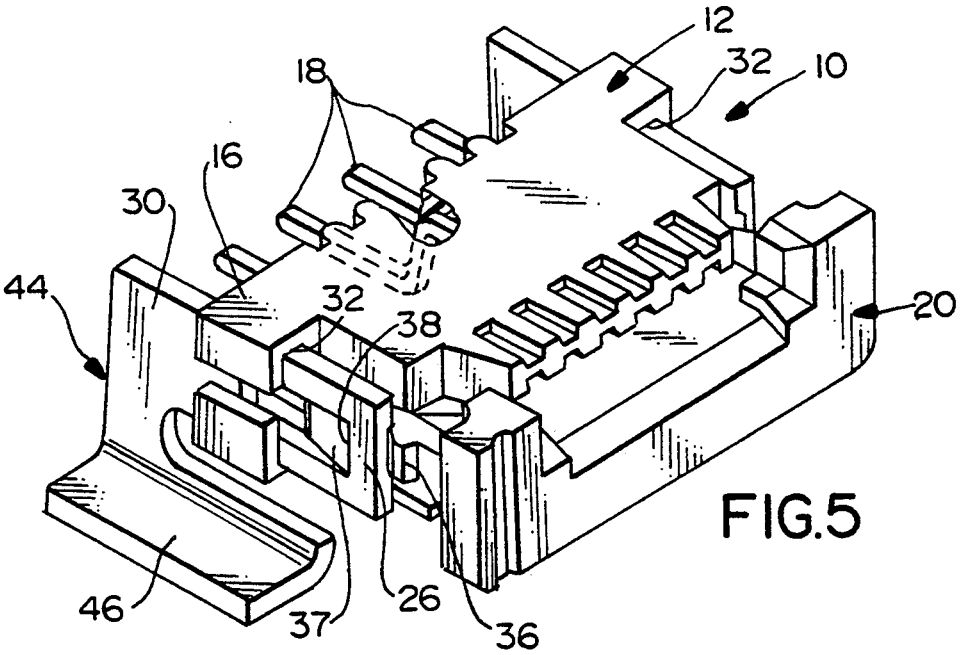
FIG. 5 is a perspective view of an electrical connector modified so as to be surface mountable at a right angle and embodying a further form of latch/mounting clip.

FIG. 5 shows connector 10 in a right angle surface-mount configuration with a latch/mounting clip, generally designated 44, which has a planar portion 46 defining a fitting nail for the same purposes as described above in relation to clips 24 and 24' in FIGS. 1 and 4, respectively. However, it can be seen that planar portion 46 of latch/mounting clip 44, in FIG. 5, is in a plane extending generally parallel to the insertion direction of actuator 20 (arrow "B" in FIG. 1), as well as generally parallel to the insertion direction of the latch/mounting clips themselves (arrows "A" in FIG. 1). This construction would be appropriate when connector housing 12 is laid on its side in a low profile mounting on the printed circuit board. In other words, the board, itself, would be generally parallel to the insertion directions of the latch/mounting clips and the actuator. It can also be seen that the terminal construction, while similar to that of FIGS. 2A and 2B is different, although such difference is not critical to the operation of the invention.

It can be seen that the planar portion 46 of latch-/mounting clip 44 is relatively long in a direction parallel to the actuation direction "B" (FIG. 1) of actuator 20. The planar portion is designed so that it extends forward from the rear of the connector towards the flat flexible circuit entry side past the center of gravity of the connector. As a result, the connector will rest solidly on planar portions 46 prior to soldering without tipping forward and causing the surface mount tails to rise up off their associated contact pads which could result in undesirable "cold" solder joints.

Figure 6:
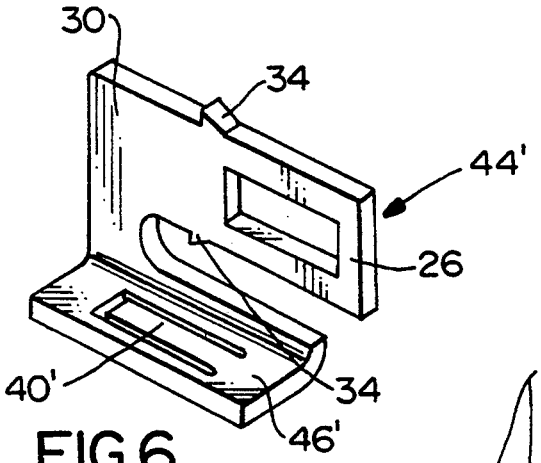
FIG. 6 is a perspective view of a latch/mounting clip similar to that of FIG. 5, but incorporating a polarizing post.

FIG. 6 shows a latch/mounting clip 44' very similar to clip 44 in FIG. 5, except that a polarizing peg 40' is stamped out of generally planar fitting nail portion 46' similar in structure and function to polarizing pegs 40 described above in relation to latch/mounting clips 24' in FIG. 4.

Figure 7:
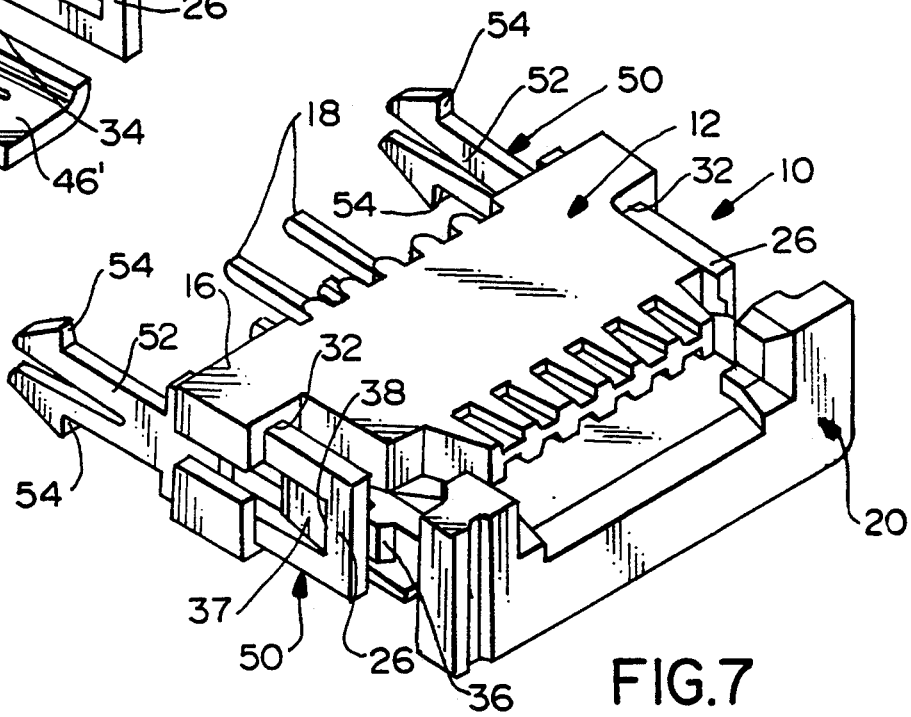
FIG. 7 is a perspective view of an electrical connector embodying still another form of a latch/mounting clip having a mounting peg.

FIG. 7 shows electrical connector 10 with a pair of latch/mounting clips, generally designated 50, which have second portions in the form of bifurcated mounting pegs 52 for insertion into appropriate mounting holes in the printed circuit board. Each bifurcated mounting peg has hook portions 54 for snappingly engaging behind an opposite surface of the printed circuit board to secure the connector to the board. Again, the opposite end of each latch/mounting clip includes first portion 26 with cutout 38 for latchingly engaging actuator 20.

Figure 8:
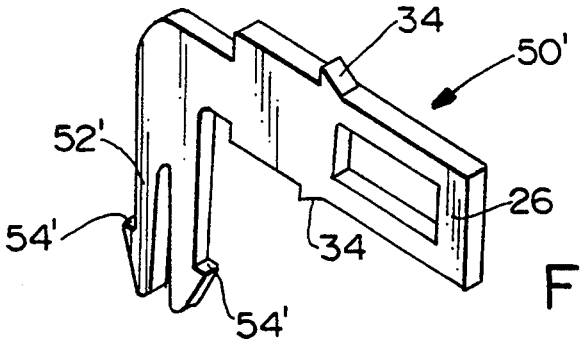
FIG. 8 is a perspective view of a latch/mounting clip similar to that of FIG. 7, but with the mounting peg at a right-angle.

FIG. 8 shows a latch/mounting clip 50' very similar to clips 50 of FIG. 7, but a bifurcated mounting peg 52' extends at a right angle for mounting the connector onto a printed circuit board which extends generally parallel to the insertion direction of actuator 20. Again, mounting peg 52' has hook portions 54' for snappingly engaging the opposite surface of the printed circuit board.

Figure 9:
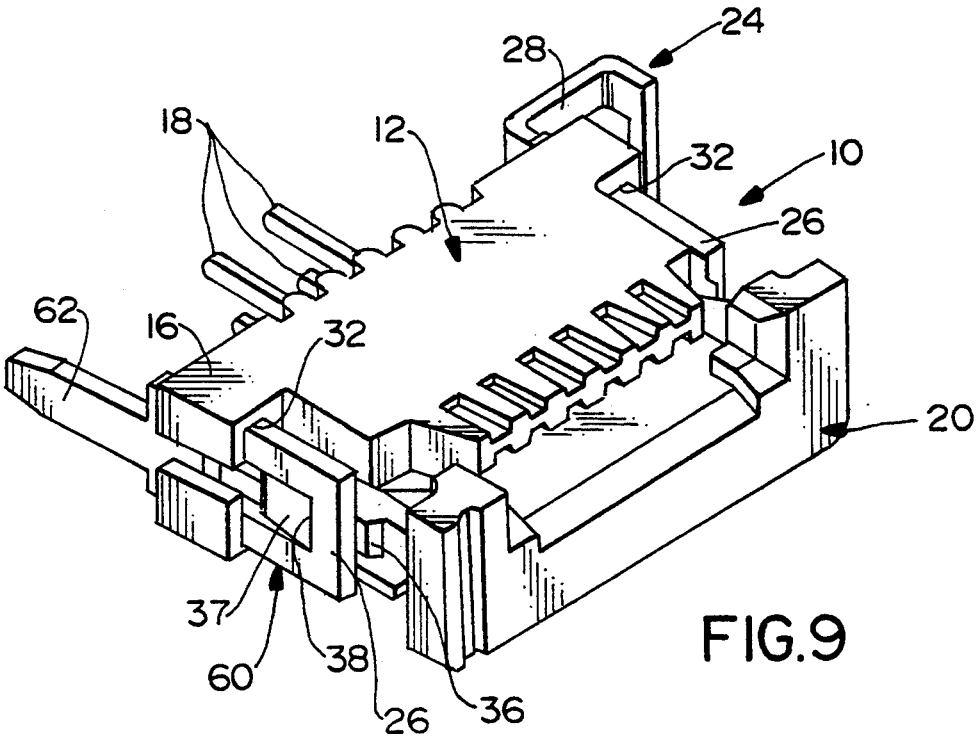
FIG. 9 is a perspective view of an electrical connector embodying yet a further form of a latch/mounting clip having a polarizing peg.

FIG. 9 shows still a further embodiment of electrical connector 10, wherein the connector includes one latch/mounting clip, generally designated 60, which has a second portion 62 defining a polarizing post or peg for insertion into an appropriate polarizing hole in the printed circuit board. Again, like all of the other latch-/mounting clips, clip 60 has a first portion 26 for snap-latch engagement with actuator 20. Since polarization is desired as one of the functions of the latch/mounting clip, the other clip 24 of the electrical connector in FIG. 9 would not include a polarizing post.

Figure 10:
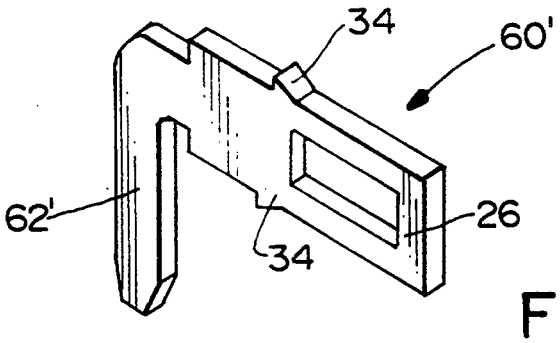
FIG. 10 is a perspective view of a latch/mounting clip similar to that of FIG. 8, but with the polarizing peg at a right-angle.

Finally, FIG. 10 shows an alternative form of latch-/mounting clip, generally designated 60', which is similar to latch/mounting clip 60 in FIG. 9, except that clip 60' has a polarizing post or peg 62' extending at a right-angle to the insertion direction of the actuator. Polarizing post 62' is adapted for insertion into a polarizing hole in a printed circuit board which extends generally parallel to the insertion direction.

From the foregoing, it can be seen that each latch-/mounting clip 24 (FIGS. 1 and 3), 24' (FIG. 4), 44 (FIG. 5), 44' (FIG. 6), 50 (FIG. 7), 50' (FIG. 8), 60 (FIG. 9) and 60' (FIG. 10) all have similar first portions 26 and cutouts 38 which combine with camming latch bosses 36 on actuator 20 to provide complementary interengaging latch means between the first portions of the clip and the actuator to hold the actuator in its fully inserted position in connector housing 12. All of the clips also perform an addition function of being operatively associated with the printed circuit board. All of latch/mounting clips 24 (FIGS. 1 and 3), 24' (FIG. 4), 44 (FIG. 5) and 44' (FIG. 6) provided a generally planar "fitting nail" for soldering to a dummy solder pad on the printed circuit board and, thereby, secure the connector to the board. Latch/mounting clips 50 (FIG. 7) and 50' (FIG. 8) both provide mounting pegs for securely mounting the connector to the printed circuit board. Latch/mounting clips 60 (FIG. 9) and 60' (FIG. 10) provide means for polarizing the connector with the printed circuit board.

By providing such multi-function latch/mounting clips, common or universal connector housings 12 and actuators 20 can be fabricated in identical configurations for a wide variety of electrical connectors performing a wide variety of functions. The only modifications necessary to the connectors are to change the configurations of the latch/mounting clips, and to change the solder tail configurations of the terminals. Vast savings are made in being able to mold universal housings and actuators. In addition, since the housings do not have any extraneous resilient latching mechanisms, the housings can be molded of a less resilient material which is less sensitive to temperature and humidity than the plastic material often used with connector housings of this type.

In a general sense, the electrical connector of the invention, as described herein, basically is provided with a two-part dielectric housing means defined by a first housing part (housing 12) and a second housing part (actuator 20), with the various embodiments of the latch/mounting clips not only providing means for holding the housing parts in interengagement, but to provide means for operative association with the printed circuit board.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector for interconnecting a flat flexible circuit to a printed circuit board, including a dielectric housing having an elongated mouth for receiving the flat flexible circuit, terminal means mounted in the housing and adapted for coupling appropriate conductors of the flat flexible circuit with circuit traces on the printed circuit board, and an actuator having an elongated tongue for insertion into the mouth of the housing to maintain the flat flexible circuit in engagement with the terminal means, wherein the improvement comprises at least one discrete latch/mounting clip mounted on the housing, complementary interengaging latch means between a first portion of the clip and the actuator to hold the actuator in its inserted position on the housing, and a second portion of the clip being adapted for operative association with the printed circuit board.

2. In an electrical connector as set forth in claim 1, wherein said housing includes a receptacle for mounting each said latch/mounting clip on said housing, said receptacle opening in a direction generally parallel to the insertion direction of the actuator to permit said clip to be inserted in a direction generally parallel to the insertion direction of the actuator.

3. In an electrical connector as set forth in claim 1, wherein at least said first portion of the latch/mounting clip is flexible and said complementary interengaging latch means thereby comprise snap-latch means for automatically latching the actuator in response to movement of the actuator to its inserted position.

4. In an electrical connector as est forth in claim 3, wherein said latch/mounting clip is fabricated of metal, and said complementary interengaging latch means include a camming latch boss on the actuator and past which the first portion of the clip snaps to give an audible indication of a fully inserted position of the actuator.

5. In an electrical connector as set forth in claim 1, wherein said second portion of the latch/mounting clip comprises a polarizing peg for insertion into an appropriate polarizing hole in the printed circuit board.

6. In an electrical connector as set forth in claim 1, wherein said second portion of the latch/mounting clip comprises a mounting peg for insertion into an appropriate mounting hole in the printed circuit board.

7. In an electrical connector as set forth in claim 6, wherein said mounted peg projects from the housing in a direction generally parallel to the insertion direction of the actuator.

8. In an electrical connector as set forth in claim 6, wherein said mounting peg projects from the housing generally in a direction at a right-angle to the insertion direction of the actuator.

9. In an electrical connector as set forth in claim 1, wherein said latch/mounting clip is fabricated of metal and said second portion of the latch/mounting clip is generally planar for soldering to a mounting pad on the printed circuit board.

10. In an electrical connector as set forth in claim 9, wherein said generally planar second portion of the latch/mounting clip is generally perpendicular to the insertion direction of the actuator.

11. In an electrical connector as set froth in claim 10, including a polarizing peg formed out of said generally planar second portion of the latch/mounting clip and adapted for insertion into an appropriate polarizing hole in the printed circuit board.

12. In an electrical connector as set forth in claim 9, wherein said generally planar second portion of the latch/mounting clip is generally parallel to the insertion direction of the actuator.

13. In an electrical connector as set forth in claim 12, including a polarizing peg formed out of said generally planar second portion of the latch/mounting clip and adapted for insertion into an appropriate polarizing hole in the printed circuit board.

14. In an electrical connector for interconnecting a flat flexible circuit to a printed circuit board, including a dielectric housing having an elongated mouth for receiving the flat flexible circuit, terminal means mounted in the housing and adapted for coupling appropriate conductors of the flat flexible circuit with circuit traces on the printed circuit board, and an actuator having an elongated tongue for insertion into the mouth of the housing to maintain the flat flexible circuit in engagement with the terminal means, wherein the improvement comprises a pair of latch/mounting clips fabricated of metal and mounted on the housing, complementary interengaging latch means between a first flexible portion of each clip and the actuator to hold the actuator in its inserted position on the housing, and a second portion of each clip being adapted for operative association with the printed circuit board, and said complementary interengaging latch means include a camming latch boss on the actuator and past which the first portion of the clip snaps to give an audible indication of a the actuator being located at its fully inserted position.

15. In an electrical connector as set forth in claim 14, wherein said second portion of one of the latch/mounting clips comprises a polarizing peg for insertion into an appropriate polarizing hole in the printed circuit board.

16. In an electrical connector as set forth in claim 14, wherein said second portion of at lest one of the latch-/mounting clips comprises a mounting peg for insertion into an appropriate mounting hole in the printed circuit board.

17. In an electrical connector as set forth in claim 14, wherein said housing includes a receptacle for mounting each said latch/mounting clip on said housing, said receptacle opening in a direction generally parallel to the insertion direction of the actuator to permit said clip to be inserted in a direction generally parallel to the insertion direction of the actuator.

18. In an electrical connector as set forth in claim 14, wherein said second portion of each said latch/mounting clip is generally planar for soldering to a mounting pad on the printed circuit board.

19. In an electrical connector as set forth in claim 18, including a polarizing peg formed out of said generally planar second portion of one of the latch/mounting clips and adapted for insertion into an appropriate polarizing hole in the printed circuit board.

* * * * *